US009302307B2

(12) United States Patent
Bestard et al.

(10) Patent No.: US 9,302,307 B2
(45) Date of Patent: Apr. 5, 2016

(54) METHOD OF FORMING HOLLOW BODY WITH FLANGE

(75) Inventors: Tom L. Bestard, Belmont (CA); Martin L. Bliss, Thorndale (CA); Ghafoor Khodayari, Richmond Hill (CA)

(73) Assignee: VARI-FORM, INC., Strathroy (CA)

( * ) Notice: Subject to any disclaimer, the term of this patent is extended or adjusted under 35 U.S.C. 154(b) by 1131 days.

(21) Appl. No.: 12/703,828

(22) Filed: Feb. 11, 2010

(65) Prior Publication Data

US 2010/0206035 A1 Aug. 19, 2010

Related U.S. Application Data

(60) Provisional application No. 61/152,870, filed on Feb. 16, 2009.

(51) Int. Cl.

| | |
|---|---|
| ***B21D 22/10*** | (2006.01) |
| ***B21D 28/18*** | (2006.01) |
| ***B21D 39/20*** | (2006.01) |
| ***B21D 26/033*** | (2011.01) |
| *B21D 39/08* | (2006.01) |
| *B21D 26/00* | (2006.01) |
| *B21D 22/00* | (2006.01) |

(52) U.S. Cl.
CPC ..... *B21D 26/033* (2013.01)

(58) Field of Classification Search
CPC .... B65B 51/04; B21D 26/033; B21D 39/021; B21D 5/04; B21D 26/14; B21D 26/047; B21D 15/10; B21D 26/045; B21D 19/046; B21D 15/02; B21C 23/007; B21C 37/104; B21B 19/04; B21B 23/00; B21K 21/12
USPC ..... 29/243.57, 243.58, 421.1; 72/316, 72/57–62, 55, 54, 56, 367.1, 368, 370.1, 72/370.11, 370.13, 370.22
See application file for complete search history.

(56) References Cited

U.S. PATENT DOCUMENTS

| | | | | |
|---|---|---|---|---|
| 4,945,682 | A | 8/1990 | Altman et al. | |
| 5,070,717 | A | 12/1991 | Boyd et al. | |
| 5,460,026 | A * | 10/1995 | Schafer | 72/55 |
| 6,032,501 | A * | 3/2000 | Bihrer | 72/58 |
| 6,739,166 | B1 * | 5/2004 | Shah | B21D 19/00 29/421.1 |

(Continued)

FOREIGN PATENT DOCUMENTS

| | | |
|---|---|---|
| EP | 2172285 A1 | 4/2010 |
| JP | 2006-061944 | 3/2006 |

(Continued)

OTHER PUBLICATIONS

European Search Report, May 18, 2010 (2 pages).

(Continued)

*Primary Examiner* — David Bryant
*Assistant Examiner* — Lawrence Averick
(74) *Attorney, Agent, or Firm* — Reising Ethington P.C.

(57) ABSTRACT

A method of forming a hollow body having a hollow flange may include performing a hydroforming process to a tubular blank. The tubular blank may be deformed and shaped to form the hollow body and the hollow flange. Subsequent processes may be performed to the hollow flange such as a flattening process whereby confronting internal surfaces of the hollow flange are brought together to abut each other and form a flat flange.

16 Claims, 3 Drawing Sheets

(56) References Cited

U.S. PATENT DOCUMENTS

| | | | | |
|---|---|---|---|---|
| 7,051,768 | B2 * | 5/2006 | Takahashi | B21D 26/033 138/114 |
| 7,249,481 | B1 | 7/2007 | Lowe | |
| 8,171,769 | B2 * | 5/2012 | Barthelemy et al. | 72/370.22 |
| 8,297,096 | B2 * | 10/2012 | Mizumura et al. | 72/57 |
| 2002/0166222 | A1 * | 11/2002 | Kojima et al. | 29/421.1 |
| 2006/0151970 | A1 * | 7/2006 | Kaminski et al. | 280/124.134 |
| 2008/0088157 | A1 * | 4/2008 | Chen et al. | 296/209 |

FOREIGN PATENT DOCUMENTS

| | | | |
|---|---|---|---|
| JP | 2006-122979 | | 5/2006 |
| JP | 2006255709 | | 9/2006 |
| WO | WO2005068102 | A1 | 7/2005 |
| WO | WO2009/014233 | A1 | 1/2009 |

OTHER PUBLICATIONS

Japanese Office Action dated Jan. 21, 2014, (2 pages).

* cited by examiner

METHOD OF FORMING HOLLOW BODY WITH FLANGE

REFERENCE TO CO-PENDING APPLICATION

This application claims the benefit of, and incorporates by reference in its entirety, U.S. Provisional Ser. No. 61/152,870 filed Feb. 16, 2009.

TECHNICAL FIELD

The present invention relates generally to forming hollow bodies, and more particularly to forming hollow bodies with flanges.

BACKGROUND

Hollow bodies of relatively complex cross-sectional profiles are commonly shaped out of tubular blanks by a hydroforming process. In such a process, a tubular blank is placed between a pair of dies matching the desired shape of an end product, the dies are closed, and an internal hydraulic pressure is developed inside of the tubular blank to cause the tubular blank to take on the shape of the dies. Flanges are sometimes formed with the hollow bodies as part of the hydroforming process. In some cases, however, forming the flanges causes cracks or other leaks to the associated hollow bodies which in turn causes the hydroforming process to fail.

SUMMARY OF THE DISCLOSURE

In at least one implementation, a method of forming a hollow body with a flange may include providing a tubular blank. The method may also include placing the tubular blank between a first die half and a second die half. The first and second die halves may have a body forming cavity portion and a flange forming cavity portion. The method may further include applying an internal hydraulic pressure to the tubular blank. The method may include closing the first and second die halves on the tubular blank whereby the body forming cavity portions may form the hollow body and the flange forming cavity portions may form a hollow flange that may extend from the hollow body. The method may also include opening the first and second die halves, and removing the hollow body and the hollow flange out of the first and second die halves. The method may further include flattening the hollow flange whereby confronting internal surfaces of the hollow flange may be brought together and may abut each other to form a flat flange.

In at least one implementation, a method of forming a hollow body having a hollow flange may include providing a tubular blank. The method may also include placing the tubular blank between a first die half and second die half. Each of the first and second die halves may have a body forming cavity portion and a flange forming cavity portion. The method may further include applying an internal hydraulic pressure to the tubular blank. The method may include closing the first and second die halves on the tubular blank whereby the body forming cavity portions may form the hollow body and the flange forming cavity portions may form a hollow flange that may extend from the hollow body. The method may also include opening the first and second die halves and removing the hollow body and the hollow flange out of the first and second die halves. The hollow body may define a first hollow space and the hollow flange may define a second hollow space. The first and second hollow spaces may be separated by an abutment interface whereby confronting internal surfaces of the tubular blank may be brought together by the first and second die halves and may contact each other at the abutment interface.

In at least one implementation, a method of forming a hollow body having a hollow flange may include providing a tubular blank and performing a hydroforming process to the tubular blank. The hydroforming process may form the hollow body and the hollow flange. A bend radius of an outer end of the hollow flange may be greater than about two times the thickness of a wall of the tubular blank at the hollow flange, and may be less than about six times the thickness of the wall of the tubular blank at the hollow flange.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Referring in more detail to the drawings, an exemplary embodiment of a tubular blank 10 is shaped by a hydroforming process into a hollow body 12 having a flange 14. Additional metalworking processes may be performed to form the hollow body 12 and flange 14 into a desired end product such as an automotive component like a door reinforcement with a flange for mounting weather strips and/or other components, for example. Of course, other applications and other components are possible.

Figure 1:
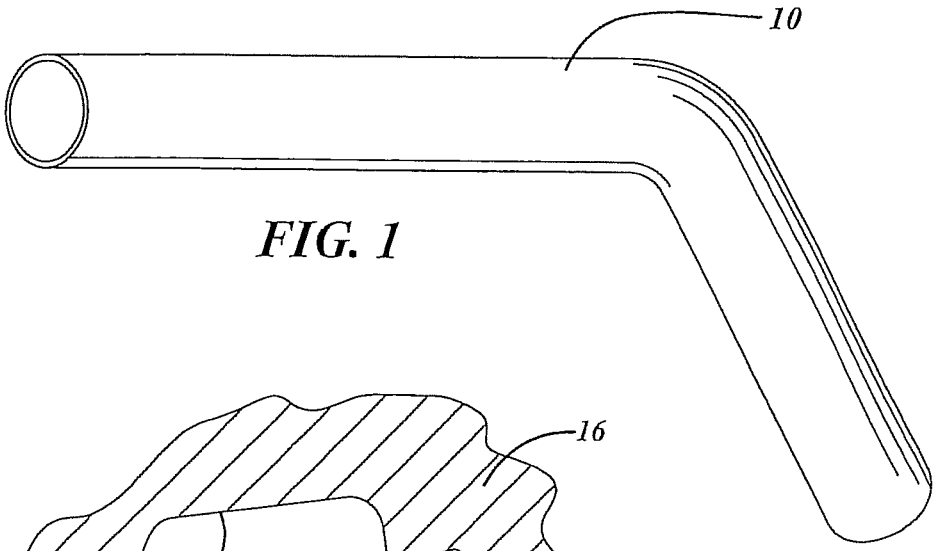
FIG. 1 is a side view of an exemplary embodiment of a tubular blank.

Referring to FIG. 1, the tubular blank 10 may have a circular cross-section, may be cut to a desired size, and may be bent into a generally L-shape by mandrel bending, stretch bending, or another suitable bending process. The tubular blank 10 may have other shapes and sizes; for example, the tubular blank need not be L-shaped and need not be bent at all. The tubular blank 10 may be composed of a uniform high strength material such as, but not limited to, a Dual Phase (DP) 780 grade steel, a DP 980 grade steel, or a 580 MPa ultimate tensile strength class steel; such steels may have relatively low elongations of less than 20 percent and may crease, crack, or otherwise leak when a portion of the material is folded flat against itself. In one exemplary embodiment, the tubular blank 10 is formed into the desired end product by a hydroforming process, and may further be formed by a flattening process, a welding process, and a cutting process. Though these processes will be described in a particular order and with particular steps, the processes may be performed in different orders and with different steps. For example, the cutting process may be performed before the welding process. And indeed not all of the processes need necessarily be performed.

Figure 2:
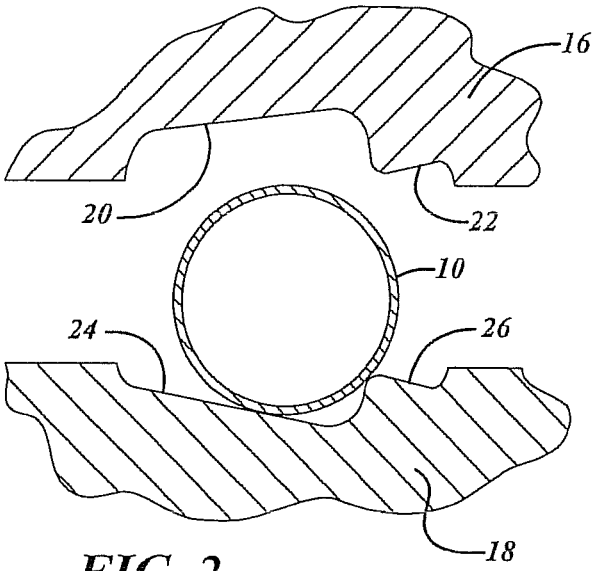
FIG. 2 is a cross-sectional view showing the tubular blank of FIG. 1 placed between a first and second die half.

The hydroforming process puts the tubular blank 10 into a different shape of comparatively complex cross-sectional profile. The hydroforming process may be a so-called pressure-sequence hydroforming process, or may be another type. Referring to FIG. 2, in a first step the tubular blank 10 is positioned in a hydroforming machine and placed between an open first die half 16 and second die half 18. The first die half 16 has a first body forming cavity 20 and a first flange forming cavity 22, and the second die half 18 has a second body forming cavity 24 and a second flange forming cavity 26. When the first and second die halves 16, 18 are brought together and completely closed, the first and second body forming cavities 20, 24 match the shape of the hollow body 12, and the first and second flange forming cavities 22, 26 match the shape of the flange 14. The first and second body forming cavities 20, 24 and the first and second flange forming cavities 22, 26 may have different shapes and sizes than shown and described here.

Figure 3:
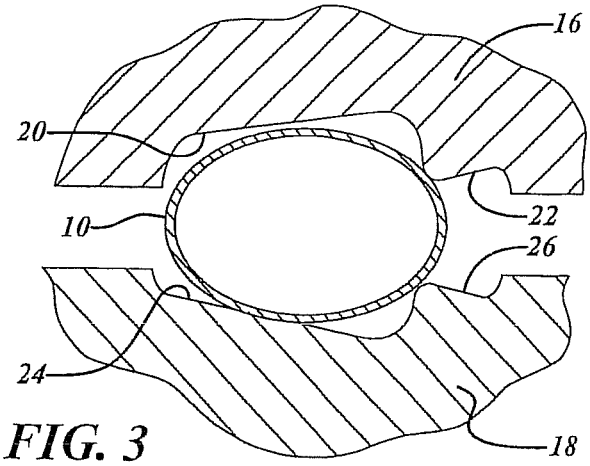
FIG. 3 is a cross-sectional view showing the first and second die halves in the midst of closing.

Referring to FIG. 3, the ends of the tubular blank 10 may be sealed and an internal hydraulic pressure may be applied inside of the tubular blank 10. The internal hydraulic pressure may be a value which supports the tubular blank 10 against collapse and/or buckling as the die halves are progressively closed while allowing the tubular blank to be deformed and shaped; in one example the internal hydraulic pressure may be about 1,000 p.s.i., though other pressure values are possible. The first and second die halves 16, 18 may be brought together and progressively closed (FIG. 3 shows a partially closed position) and the tubular blank 10 may in turn be progressively deformed and shaped. In different examples, the internal hydraulic pressure may remain the same or may be progressively increased as the first and second die halves 16, 18 are brought together. In one embodiment, a pressure relief valve (not shown) may be equipped into the end seals of the tubular blank 10.

Figure 4:
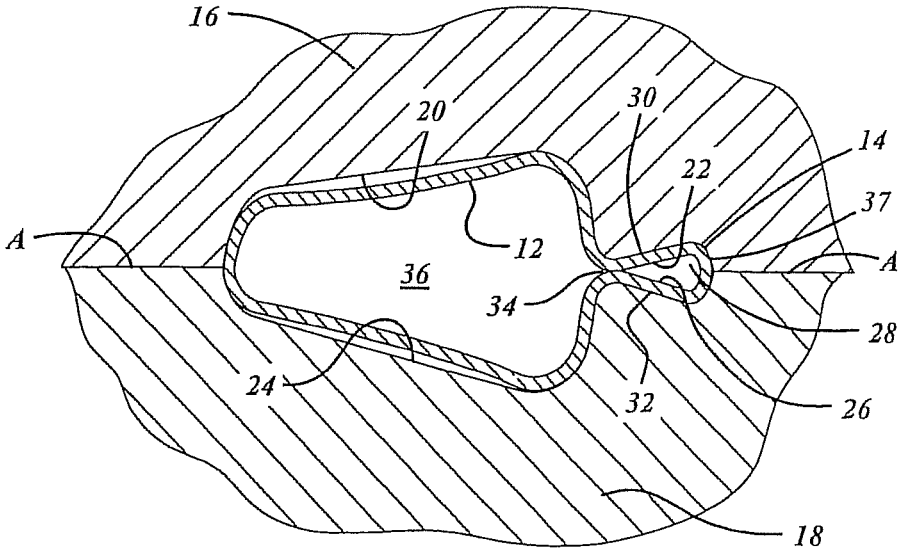
FIG. 4 is a cross-sectional view showing the first and second halves completely closed, and before an increased internal hydraulic pressure is applied to the tubular blank.

Referring to FIG. 4, the first and second die halves 16, 18 are completely closed. The tubular blank 10 may now have the hollow body 12 and the flange 14 in a hollow state. The hollow flange 14 has a first flange wall 30 and an opposing second flange wall 32 that may be closed or pinched together by the first and second flange forming cavities 22, 26 at an abutment interface 34 to define at least one hollow space 28. In one embodiment, the flange walls 30, 32 do not contact each other anywhere else. The hollow space 28 is separated by the abutment interface 34 from a hollow space 36 defined by the hollow body 12. The depth of each of the first and second flange forming cavities 22, 26 adjacent the abutment interface 34 with respect to a split line A may be approximately equal to the thickness of a wall of the tubular blank 10 thereat. By contrast, the depth of each of the first and second flange forming cavities 22, 26 at positions other than at the abutment interface 34 may be greater than the wall thickness of the tubular blank 10. The depth at the other positions may be about four times the wall thickness, and may range between about twice the wall thickness and six times the wall thickness. A radiused outside corner at an outer end 37 of the hollow flange 14 and at other bends formed in the tubular blank 10 may measure greater than about two times the wall thickness and less than about six times the wall thickness (these relationships refer to the state of the hollow flange as shown in FIG. 4). In one embodiment, the radiused outside corner (i.e., bend radius) may produce a ratio of radiused corner to wall thickness between about 2:1 and 6:1. Staying within these relationships may avoid creating a crease, crack, or other leak at the outer end 37. Example wall thicknesses include 0.8 mm and 2.0 mm, giving corresponding bend radii of 1.6 mm for the 2:1 ratio, and 12.0 mm for the 6:1 ratio. Other wall thicknesses and corresponding bend radii are of course possible.

Figure 5:
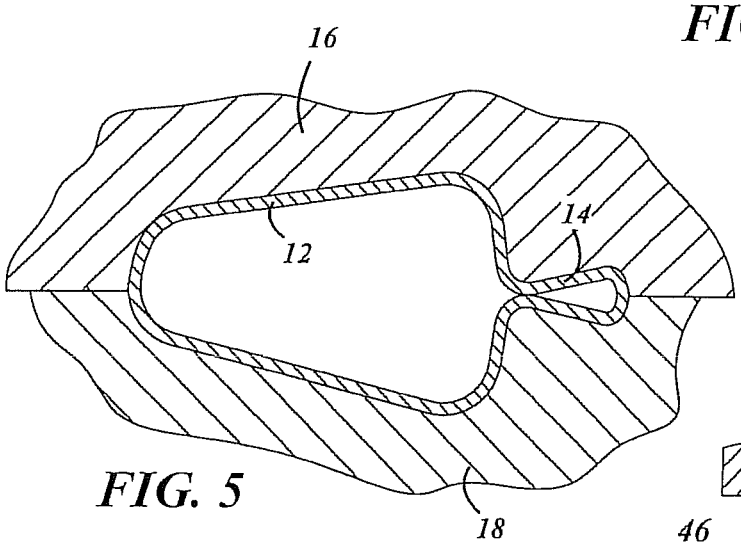
FIG. 5 is a cross-sectional view showing the first and second die halves completely closed, and after the increased internal hydraulic pressure is applied to the tubular blank.

Referring to FIG. 5, while the first and second die halves 16, 18 are maintained completely closed, the internal hydraulic pressure may be increased in value inside of the mostly formed hollow body 12 to cause the body to conform to the shape of the first and second die halves 16, 18. The increased internal hydraulic pressure may be a value which forces the walls of the tubular blank 10 against the first and second die halves 16, 18 and/or may be a value which supports the blank against collapse or unwanted deformation as holes are punched in the blank; in one example the increased internal hydraulic pressure may be about 10,000 p.s.i., though other pressure values are possible. The increased internal hydraulic pressure may then be ceased, the first and second die halves 16, 18 may be opened, and the one-piece hollow body 12 with hollow flange 14 may be removed. In this exemplary hydroforming process, the internal hydraulic pressure may be provided at a level such that a cross-section of the tubular blank is not expanded. In other words, the thickness of the walls of the tubular blank are not thinned in any appreciable way (except it is possible to have slight expansion at local areas of bending), and instead only the shape of the cross-section is modified (i.e., deformed) such as by the compressive forces provided on the tubular blank by the die halves during the process, while the perimeter length of the cross-sectioned walls does not change. In this example, the internal hydraulic pressure is insufficient to expand the tubular blank and, in a sense, the hydraulic pressure acts as a mandrel during the hydroforming process. Of course, in other exemplary hydroforming processes, the tubular blank could be expanded.

Figure 6:
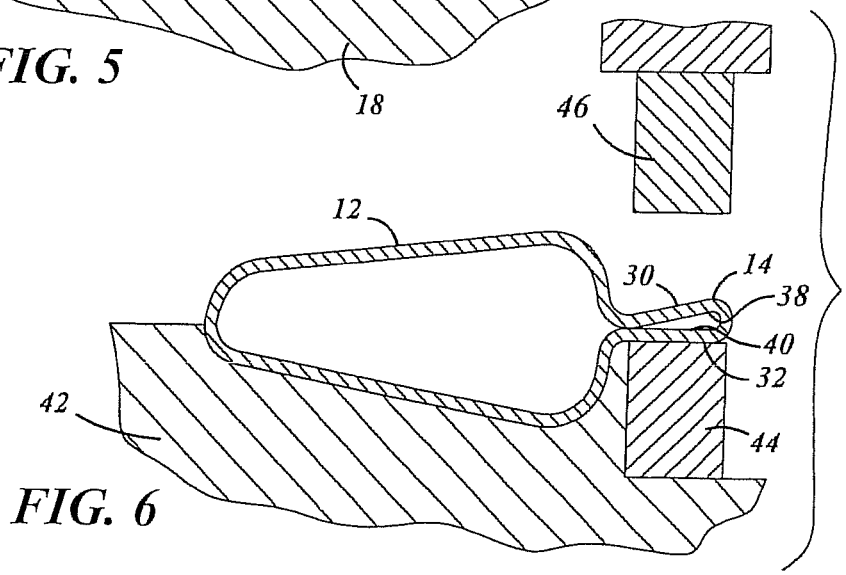
FIG. 6 is a cross-sectional view of an initial stage of an exemplary coining process.
Figure 7:
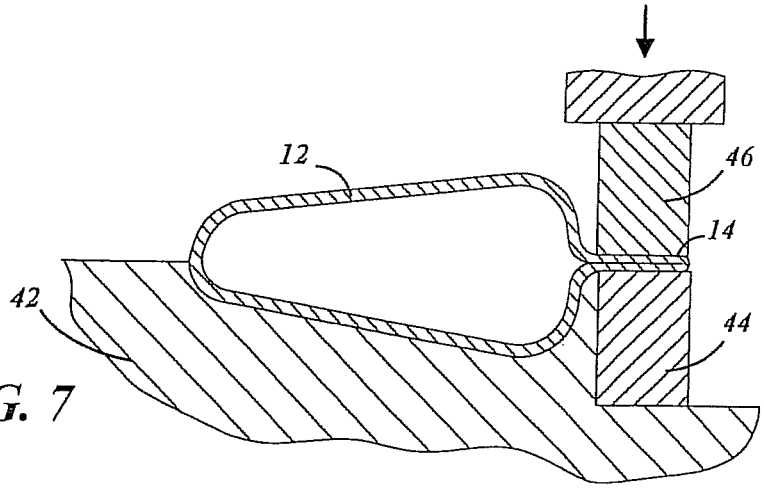
FIG. 7 is a cross-sectional view of a subsequent stage of the coining process of FIG. 6.

The flattening process forms the hollow flange 14 into the flat flange (FIG. 7). The hollow body 12 and hollow flange 14 may be transported away from the hydroforming machine and to a separate machine for the flattening process. The flattening process may be a metalworking process that forms the hollow flange 14 into the flat flange such that confronting internal surfaces 38, 40 of the first and second flange walls 30, 32 are brought together to abut each other along their respective lengths. Referring to FIG. 6, in one exemplary embodiment the flattening process is a coining process. The hollow body 12 may be fixtured or otherwise held in a coining machine 42 with the hollow flange 14 located on a stationary die 44. Referring to FIG. 7, a coining die 46 strikes one side of the hollow flange 14 and flattens the flange and closes the hollow space 28 to form the flat flange. The coining die 46 may be refracted and the hollow body 12 with flat flange 14 may be removed. Depending on the material of the tubular blank 10, during the flattening process the flange 14, the hollow body 12, or both, may develop cracks which do not affect the structural integrity of the hollow body and/or flange but which could have adversely affected the hydroforming process if they developed during that process. Because the flattening process is performed after the hydroforming process, any potential cracks do not affect the hydroforming process. Of course, cracks may not develop at all. Other flattening processes are possible.

Figure 8:
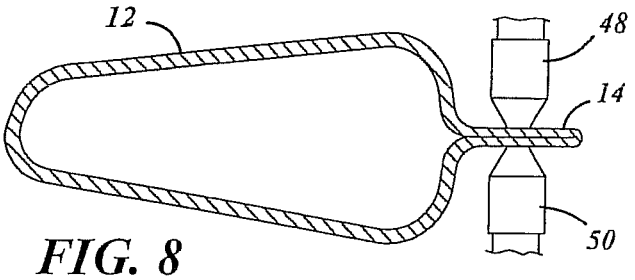
FIG. 8 is a cross-sectional view of an exemplary welding process.

The welding process joins the first and second flange walls 30, 32 together and strengthens the flat flange 14. The hollow body 12 and flat flange 14 may be transported away from the flattening machine and to a separate welding machine for the welding process. Referring to FIG. 8, in one exemplary embodiment the welding process is a spot welding process. The hollow body 12 may be fixtured or otherwise held with the flat flange 14 located between a first welding electrode 48 and a second welding electrode 50. The first and second welding electrodes 48, 50 come together at the flat flange 14 to join the first and second flange walls 30, 32 together. Other welding processes are possible.

Figure 9:
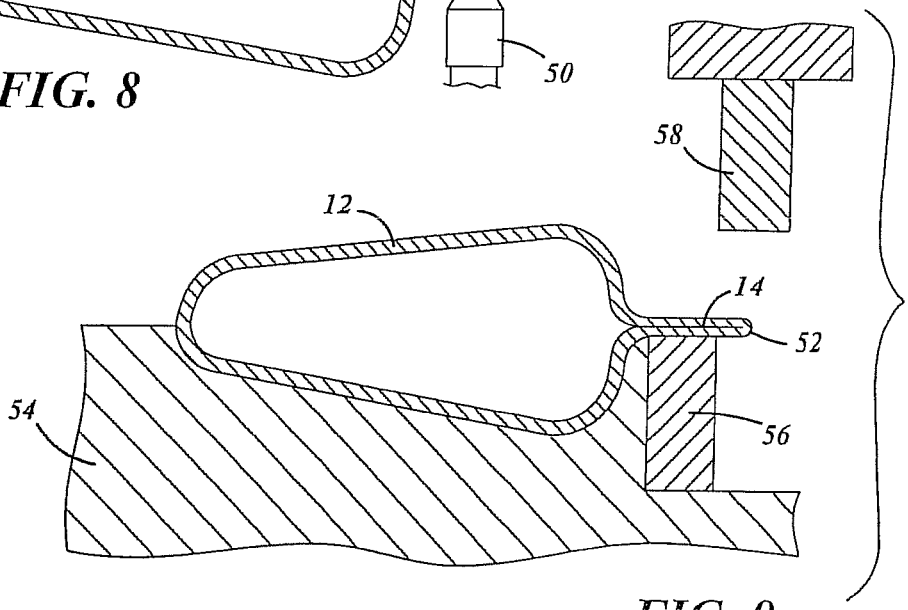
FIG. 9 is a cross-sectional view of an exemplary shearing process.

The cutting process removes a terminal end 52 of the flat flange 14 off of the flange and produces a shorter edge thereat. The hollow body 12 and flat flange 14 may be transported away from the welding machine and to a separate cutting machine for the cutting process. Referring to FIG. 9, in one exemplary embodiment the cutting process is a shearing process. The hollow body 12 may be fixtured or otherwise held in a shearing machine 54 with the flat flange 14 located on a fixed blade 56. A moving blade 58 comes down on the terminal end 52 and shears the end off of the flat flange 14. Other cutting processes are possible.

Figure 10:
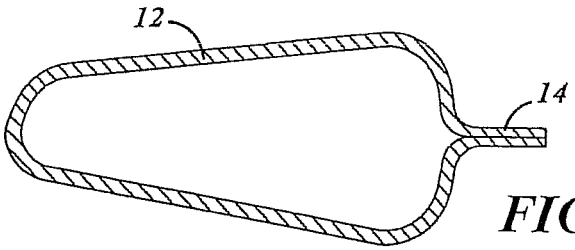
FIG. 10 is a cross-sectional view of an exemplary embodiment of a hollow body with a flange.

Once removed from the cutting machine, the hollow body 12 and flat flange 14 are at least mostly complete as shown by a cross-sectional profile of the desired end product of FIG. 10. In some cases, additional subsequent processes may be performed. For example, further metalworking and shaping may be performed to the hollow body 12, to the flat flange 14, or to both, depending on the application of the desired end product. Furthermore, the desired end product need not necessarily have the cross-sectional profile of FIG. 10 throughout its entire extent; for example, there may be portions of the desired end product that do not have the flat flange 14 and instead only have the hollow body 12, and there may be portions of the flat flange 14 that extend a distance from the hollow body farther or less than other portions of the flat flange.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A method of forming a hollow body with a flange, the method comprising:

providing a tubular blank;

placing the tubular blank between a first die half and a second die half, each of the first and second die halves having a body forming cavity portion and a flange forming cavity portion;

applying an internal hydraulic pressure to the tubular blank while the tubular blank is within said body forming cavity portion and said flange forming cavity portion;

closing the first and second die halves on the tubular blank whereby the body forming cavity portions form the hollow body and the flange forming cavity portions form a hollow flange extending from the hollow body wherein the hollow flange has a hollow space defined in part by spaced apart internal surfaces of the hollow flange and by an abutment interface whereby the internal surfaces come together and contact each other;

opening the first and second die halves;

removing the hollow body and hollow flange out of the first and second die halves; and flattening the hollow flange after the hollow body and hollow flange have been removed from the die halves whereby confronting internal surfaces of the hollow flange are brought together to abut each other and form a flat flange.

2. The method of claim 1 wherein flattening the hollow flange comprises coining the hollow flange whereby confronting internal surfaces of the hollow flange are brought together to abut each other and form the flat flange.

3. The method of claim 1 further comprising welding the abutting internal surfaces of the flat flange together.

4. The method of claim 1 further comprising cutting a terminal end of the flat flange off.

5. The method of claim 4 wherein cutting the terminal end comprises shearing the terminal end of the flat flange off.

6. The method of claim 1 wherein the depth of each of a first and second flange forming cavity portion at the abutment interface with respect to a split line A of the first and second die halves is approximately equal to the thickness of a wall of the tubular blank at the abutment interface.

7. The method of claim 1 wherein a bend radius of an outer end of the hollow flange is greater than about two times the thickness of a wall of the tubular blank at the hollow flange, and is less than about six times the thickness of the wall of the tubular blank at the hollow flange.

8. The method of claim 1 wherein the tubular blank is composed of a high strength steel.

9. A method of forming a hollow body having a hollow flange, the method comprising:

providing a tubular blank;

placing the tubular blank between a first die half and a second die half, each of the first and second die halves having a body forming cavity portion and a flange forming cavity portion wherein the flange forming cavity portion is offset from an axis of the body forming cavity portion;

applying an internal hydraulic pressure to the tubular blank while the tubular blank is within said body forming cavity portion and said flange forming cavity portion;

closing the first and second die halves on the tubular blank whereby the body forming cavity portions form the hollow body and the flange forming cavity portions form a hollow flange extending from the hollow body;

opening the first and second die halves; and removing the hollow body and hollow flange out of the first and second die halves, the hollow body defining a first hollow space and the hollow flange defining a second hollow space, the first and second hollow spaces being separated by an abutment interface whereby confronting internal surfaces of the tubular blank are brought together by the first and second die halves and contact each other at the abutment interface.

10. The method of claim 9 wherein the depth of each of a first and second flange forming cavity portion at the abutment interface with respect to a split line A of the first and second die halves is approximately equal to the thickness of a wall of the tubular blank at the abutment interface.

11. The method of claim 9 wherein a bend radius of an outer end of the hollow flange is greater than about two times the thickness of a wall of the tubular blank at the hollow flange, and is less than about six times the thickness of the wall of the tubular blank at the hollow flange.

12. The method of claim 1 wherein the hollow flange has a first flange wall and an opposing second flange wall that is engaged with the first flange wall at an abutment interface and the flange walls do not contact each other anywhere else before said flattening step is performed.

13. The method of claim 1 wherein the depth of the flange forming cavity portion of the first and second die halves is not constant along the length of the flange forming cavity portion.

14. A method of forming a hollow body having a hollow flange, comprising:

providing a tubular blank; and performing a hydroforming process to the tubular blank to form the hollow body and the follow flange, wherein a bend radius of an outer end of the hollow flange is greater than two times the thickness of a wall of the tubular blank at the hollow flange, and is less than about six times the thickness of the wall of the tubular blank at the hollow flange, and wherein the hollow body defines a first hollow space and the hollow flange defines a second hollow space, the first and second hollow spaces being separated by an abutment interface whereby confronting internal surfaces of the tubular blank are brought together by the first and second die halves and contact each other at the abutment interface.

15. The method of claim 14 wherein the hydroforming process only involves deforming the tubular blank and does not involve expanding the tubular blank.

16. The method of claim 14 wherein the tubular blank is composed of a high strength steel.

* * * * *